United States Patent [19]

Pfouts et al.

[11] 4,029,145

[45] June 14, 1977

[54] BRAZELESS HEAT EXCHANGER OF THE TUBE AND SHELL TYPE

[75] Inventors: Robert R. Pfouts, Dayton; Thomas E. Earl; Charles B. Mort, both of Findlay, all of Ohio

[73] Assignee: United Aircraft Products, Inc., Dayton, Ohio

[22] Filed: Mar. 5, 1976

[21] Appl. No.: 664,397

[52] U.S. Cl. ..... 165/161

[51] Int. Cl.[2] ..... F28F 9/22

[58] Field of Search ..... 165/133–135, 165/158–162, 82–83

[56] References Cited

UNITED STATES PATENTS

| | | | |
|---|---|---|---|
| 2,049,748 | 8/1936 | Rathbun | 165/160 |
| 2,196,683 | 4/1940 | Pickstone | 165/82 |
| 2,292,524 | 8/1942 | Jacocks | 165/82 |
| 2,762,611 | 9/1956 | Monroe et al. | 165/82 |
| 3,301,321 | 1/1967 | Poore | 165/82 |

*Primary Examiner*—C. J. Husar
*Assistant Examiner*—Theophil W. Streule, Jr.
*Attorney, Agent, or Firm*—J. E. Beringer

[57] ABSTRACT

A tube and shell heat exchanger having compact, high performance characteristics in which the core unit comprising tube assembly, headers and baffles is removably installed in a shell and has a cushioned mounting therein. A use of resilient O-rings on the headers is contemplated as well as a use of flexible, resilient baffles, one of which wraps the core unit and acts as a seal by-pass member.

12 Claims, 11 Drawing Figures

FIG-1
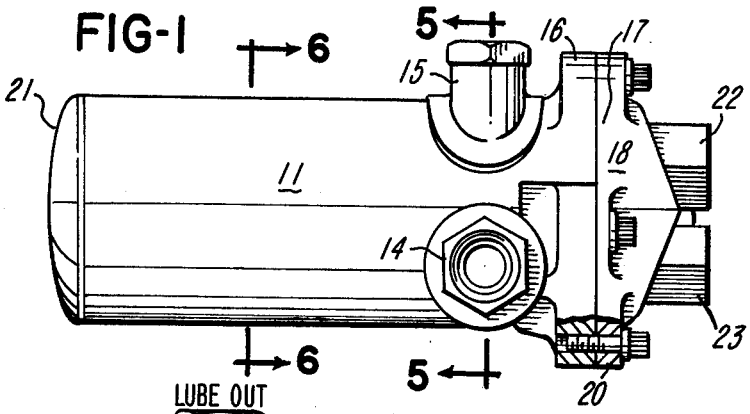
FIG-2
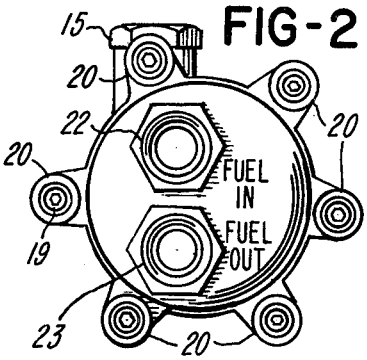
FIG-3
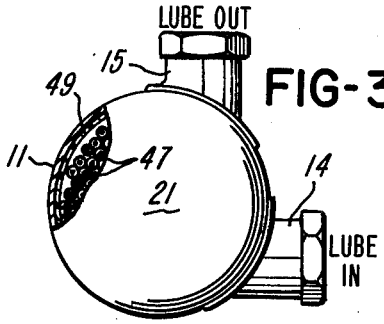
FIG-7
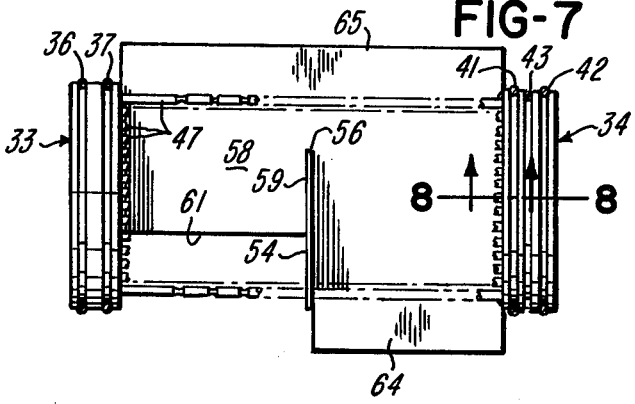
FIG-8
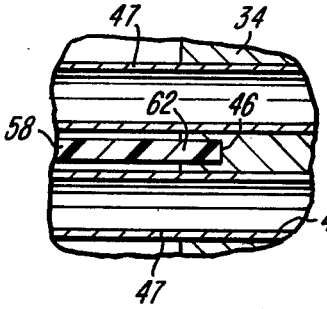
FIG-10
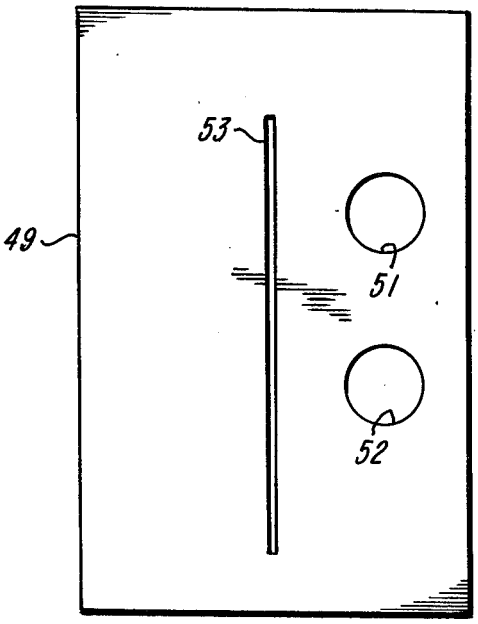
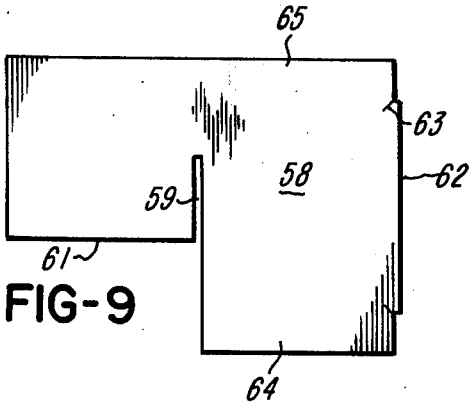
FIG-9

BRAZELESS HEAT EXCHANGER OF THE TUBE AND SHELL TYPE

BACKGROUND OF THE INVENTION

Brazed heat exchangers have enjoyed and continue to enjoy considerable popularity in the heat exchanger art, particularly among manufacturers of lightweight, compact and high performance heat exchangers as used in aircraft. There is growing interest, however, in brazeless heat exchangers, that is, heat exchangers in which means other than metallurgical bonding are used to close and seal the numerous existing joints. It is hoped thereby to avoid problems known in the art, resulting from defectively brazed joints, salt contamination, vibration induced fracturing of brazed joints and like causes. It would be hoped also that an unbrazed heat exchanger would allow access to its tubular core for inspection and servicing. The achieving of these objectives is not obvious, however. The known prior art provides no examples of high density, high performance heat exchangers to which a designer may turn in attempting to respond to the interest in unbrazed constructions.

SUMMARY OF THE INVENTION

This invention provides a comprehensive teaching of an unbrazed heat exchanger but has particular reference to the installation and mounting of a core unit in a heat exchanger of the tube and shell type. According to a feature of the invention, the core unit has a cushioned mounting in a shell in which it is received, obviating vibration induced problems. In this connection, tube mounting headers are encircled by resilient O-rings which, in bearing against an interior shell surface, both seal the header periphery and cushion the core unit within the shell. The core unit between the headers is wrapped by a flexible resilient member acting as a seal by-pass in connection with shell side fluid and contributing also to the cushioning of the core unit. Further comprised in the core unit is a baffle divider utilizing projected, deformed tabs at its sides in a cushioning effect and in a more positive control over fluid flow over and around the tubes. The core unit is removable from the shell and there is disclosed a removable manifold housing confining the core unit in place and uniquely cooperating with the shell and with the core unit in controlling flow of tube side fluid.

It is an object of the invention to provide a brazeless heat exchanger of the tube and shell type substantially as set out above.

Other objects and structural details of the invention will appear more clearly from the following description, when read in connection with the accompanying drawings, wherein:

FIG. 1 is a view in side elevation of a brazeless heat exchanger in accordance with the illustrated embodiment of the invention;

FIG. 2 is a view in end elevation of the device of FIG. 1;

FIG. 3 is a view like FIG. 2, showing the opposite end of the device;

FIG. 7 is a detail view of the core unit, taken from the top thereof and showing the parts as they appear prior to assembly;

FIG. 8 is a detail view of a slotted portion of a header plate;

FIG. 9 is a detail view of a baffle divider comprised in the core unit; and

FIG. 10 is a detail view of a seal by-pass member comprised in the core unit.

Figures 4, 5, 6:
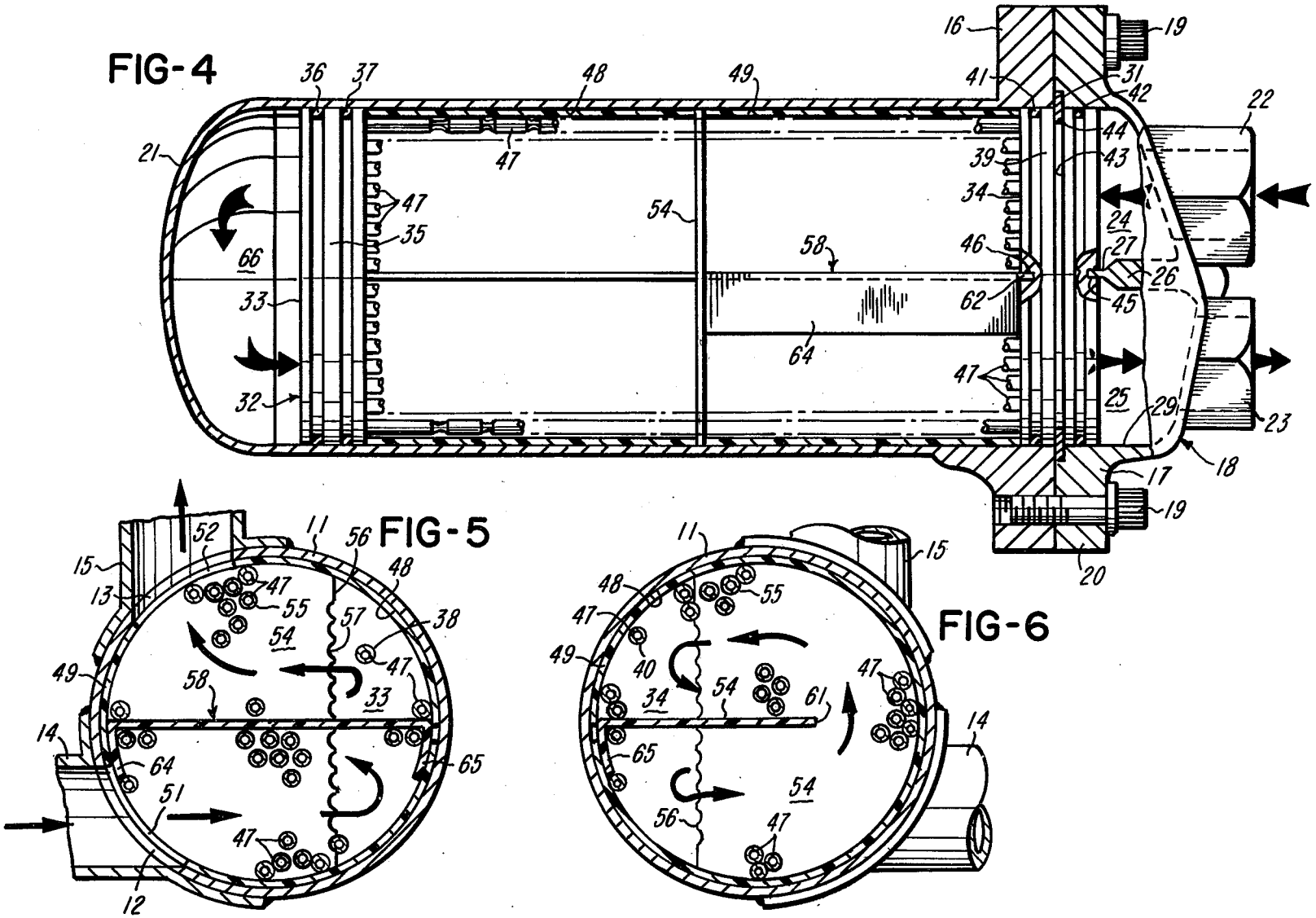
FIG. 4 is a view of the exemplary heat exchanger in longitudinal section.
FIG. 5 is a view in cross section taken substantially along the line 5—5 of FIG. 1.
FIG. 6 is a view in cross section taken substantially along the line 6—6 of FIG. 1.
Figure 11:
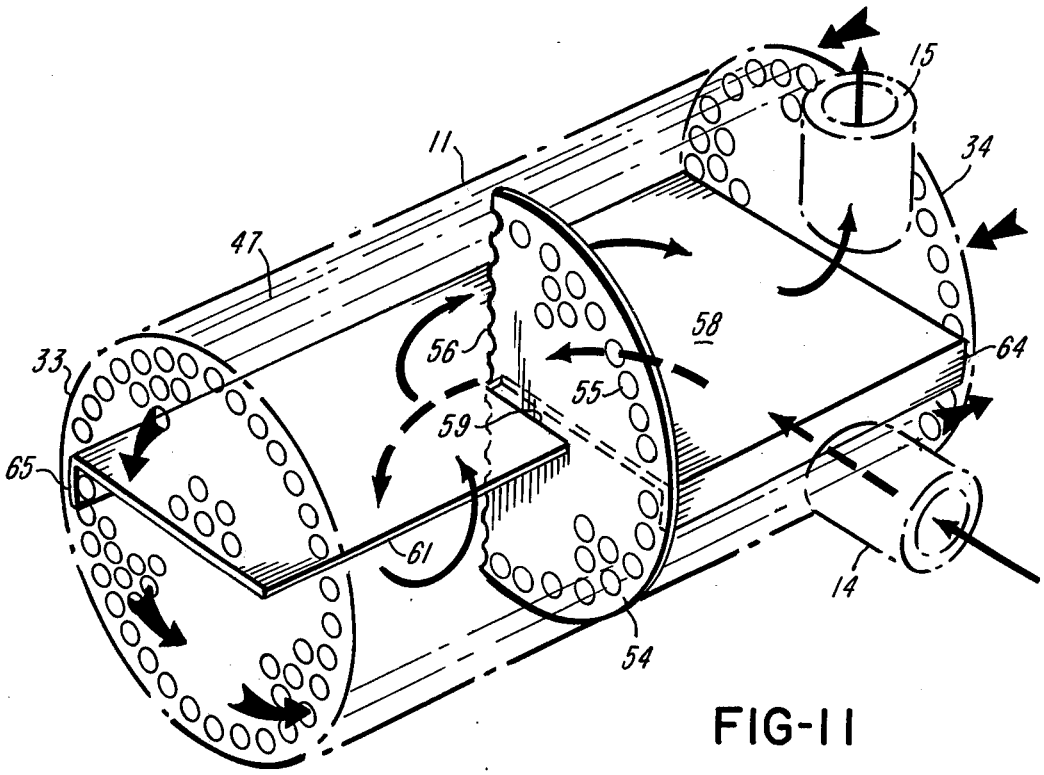
FIG. 11 is a perspective view of the core unit indicating further the fluid flow paths of FIGS. 4, 5 and 6.

Referring to the drawings, a brazeless heat exchanger according to the illustrated embodiment of the invention is a compact device in which two confined fluids of different temperature are placed in a heat transfer relation, both fluids being comprised in flowing streams. The exemplary embodiment is applicable in an aircraft engine system where flowing fuel is used to cool flowing lubricating oil. For convenience, therefore, the fluid of higher temperature will be identified herein as oil and the fluid of lower temperature as fuel. It is of course understood that invention aspects disclosed and claimed herein exist entirely independently of uses to which they may be put and of environments in which they may appear.

A tubular shell 11 has near its one end circumferentially spaced apart radial openings 12 and 13. Mounted to the outer surface of the shell and superimposing over opening 12 is a fluid inlet fitting 14 marked "Lube In" since it is adapted to be so connected to receive a flowing lubricating oil which has in use been heated. Similarly superimposing over opening 13 is an outlet fitting 15 marked "Lube Out" since it is adapted to be so connected to return cooled lubricating oil to a lubricant circulating system for reuse. At its above mentioned one end, the shell 11 is surrounded by a flange 16. The fittings 14 and 15, and the flange 16, are bonded in an appropriate manner to the exterior shell surface so that they are fixed thereon. In face to face engagement with the flange 16 is a flange 17 which is a part of a manifold housing 18. The flange 16 and projecting ears 20 on the flange 17 have mating circumferentially spaced apertures in which screw studs 19 are installed. The screw studs 19 have protruding heads readily accessible for turning so that the manifold housing 18 may be easily applied to and removed from the shell. In an installed position as illustrated the manifold housing 18 effectively closes the described one end of the shell. At its other end, shell 11 is closed by a recessed or dome-like member 21 welded to the said other shell end. The manifold housing 18 is formed integrally with a "Fuel In" fitting 22 and with a "Fuel Out" outlet fitting 23. The heat exchanger, it will be understood, is adapted to be inserted or installed in a line in which the fuel is continuously pumped during operation of the engine so that there is continuing flow of fuel into the heat exchanger by way of inlet fitting 22 and out of the heat exchanger by way of outlet fitting 23. The manifold housing 18 is a member cast or otherwise formed to have interior chambers 24 and 25 communicating respectively with the inlet fitting 22 and the outlet fitting 23. The chambers 24 and 25 lie on opposite sides of an interior partitioning member 26 which terminates at an outer extremity in a reduced, flat edge 27. A peripheral interior portion of the manifold housing, surrounding chambers 24 and 25, is machined to provide a surface 29 which in an installed position of the manifold housing forms an extension of the interior surface of shell 11. At what may be regarded as an outer extremity thereof, the surface 29 terminates in a recess 31 in the face of flange 17.

Received in the shell 11 is a core unit 32 in part comprising longitudinally spaced apart header plates 33 and 34. Plate 33 has a disc-like configuration and in its configuration conforms approximately to the internal dimensions of the shell 11. A flat peripheral surface 35 of the header plate 33 has a pair of longitudinally spaced apart circumferential grooves in which are installed respective resilient O-rings 36 and 37. The plate 33 has a substantial sliding contact in the shell 11. O-rings 36 and 37 are compressed in their respective grooves by the interior shell wall and react with a resilient, radially outwardly directed pressure upon the shell wall. The arrangement effectively seals against a flow of fluid over or across peripheral surface 35, and, in addition, provides a cushioned mounting of the header plate within the heat exchanger shell. A plurality of tube accommodating through apertures 38 are in the header plate 33. The apertures 38 most adjacent to peripheral surface 35 are spaced inwardly of such surface a distance sufficient as not to intersect the circumferential grooves which are provided to accommodate O-rings 36 and 37.

The header plate 34 is structured like the header plate 33 to have through tube accommodating apertures 40 (FIG. 8) and to have a configuration for substantially sliding contact with the interior wall of shell 11 and with surface 29 of manifold housing 18. The header plate 34 has a flat peripheral surface 39 in which are longitudinally spaced apart grooves accommodating O-rings 41 and 42. These act, like the O-rings 36–37, in preventing fluid flow over or across surface 39 and in providing a cushioned mounting for the header plate in which they are installed. Intermediately of the slots accommodating O-rings 41 and 42, in the surface 39, is a slot 43. This serves, as will hereinafter more clearly appear, to receive an inner peripheral edge of a retainer ring 44 which seats in recess 31 in a manner to be clamped between flanges 16 and 17. In what may be regarded as an outer face of the header plate 34 is a transverse slot 45 adapted to receive the reduced edge 27 of the flow divider or partitioning member 26. The latter arrangement positively precludes direct or by-passing communication between the manifold chambers 24 and 25, and, in addition, restrains the header plate 34 from relative rotary motion. Retainer ring 44 acts as a key, restraining the header plate 34 from relative endwise motion within the shell. Finally, there is formed in the header plate 34, on what may be regarded as an inner face thereof, a slot 46 which as will be seen is provided to position one end of a baffle divider member comprised in the core unit.

Heat transfer tubes 47 extend between the header plates 33 and 34 and have their ends received in the through apertures of respective plates. In an expansion or like process, the tube ends are fixed within respective tube accommodating apertures in a manner to prevent relative longitudinal movement between the tubes and header plates and to prevent a flow of fluid through the apertures around the tube ends. The tubes 47 are thin walled members adapted for an efficient conduct of heat between a fluid flowing through the tubes and a fluid moving externally of the tubes. In the illustrated instance, the tubes are constructed with longitudinally spaced apart beads which act as turbulizers in promoting a more efficient use of the heat transfer surface as provided by the tube walls. Straight walled tubes, with or without internal turbulizers, can, of course, be used if desired. The apertures 38 in header plate 35 and corresponding apertures in header plate 34 are relatively closely spaced. The tubes which are accommodated in such apertures accordingly form an assembly of closely spaced apart tubes, in which assembly the spaces between adjacent tubes form relatively narrow, randomly interconnecting flow passages for a shell side fluid. By reason of the inwardly spaced location of outermost tube apertures, there is provided between outermost tubes of the tube assembly and the interior wall of shell 11 a space 48 which if not blocked allows by-passing flow around the tube assembly. Inhibiting such by-passing flow is a seal by-pass member 49 (see also FIG. 10). The member 49 is a flat sheet-like part made of a flexible, resilient material, as for example a tetrafluoroethylene material. The sheet-like member is wrapped around the tube assembly and has a thickness and a length substantially fully to occupy space 48. Side edges of the seal by-pass member are in an approaching relation to the inner faces of respective header plates 33 and 34. Opposite ends of the by-pass member are in a relative approaching relation to one another. Near one side edge of the seal by-pass member are longitudinally spaced apart openings 51 and 52 while intermediate the side edges and contained within the margins of the member in a longitudinal sense is an elongated slot 53. Openings 51 and 52 are located and dimensioned to line up with shell apertures 12 and 13 so that shell side fluid can flow to and from the tube assembly. The slot 53 is adapted to achieve an interlocking relation with the peripheral edge of a baffle member 54 which mounts in the core unit in a transverse relation to the tubes 47. The baffle 54 has a disc-like configuration and has a relatively close fit in the shell 11, the peripheral edge of the baffle being in a substantially contacting relation to the inner shell wall. The baffle has through apertures 55 (see FIG. 5) through which tubes 47 pass in extending between the header plates 33 and 34. While disc-like in configuration, the baffle 54 is truncated in form in that a segment thereof is cut away, leaving a vertical edge 56 in facing spaced apart relation to a portion of the shell wall. The edge 56 may be formed as shown with a series of arcuate surfaces 57 for a nested engagement with an adjacent row of tubes 47.

Completing the core unit is a baffle divider member 58. This member, as shown particularly in FIG. 9, is a flat, sheet-like member made of a material like that of which the seal by-pass member 49 is made. It has a generally rectangular shape and there is formed therein a slot 59 which originates at about a mid point of the member and extends to and through one side edge thereof. A corner of the member adjacent to slot 59 is cut away to define a truncated edge 61 inwardly offset from that side edge of the member to the other side of slot 59. Further, one end of member 58 is cut away at its corners to define a short length projection 62 at the said one end. Cuts 63 are made in the material at the base of projection 62 to allow sides of the member to be deformed or deflected more readily relative to projection 62. The baffle divider 58 occupies a position in the core unit transversely of baffle member 54 and is applied in a sense facing baffle edge 56, with the baffle 54 interfitting in slot 59. The maximum width of the baffle divider exceeds the inner diameter of shell 11, and, in conforming to the interior shell dimensions, side edges of the baffle divider are bent out of the plane thereof in the manner of tabs 64 and 65. The tabs 64 and 65 bear directly against either the shell wall or the inner surface of seal by-pass member 49, and, by reason of the material of which the divider is made, exert an expanding pressure against the shell or by-pass member. Note may be taken in this connection that the material of which the baffle divider is made has the property of elastic memory in that a portion thereof bent out of its normal plane attempts to return to such plane. The baffle divider member 58 positions centrally of the core unit and effectively divides it into upper and lower portions except for an open flow area as defined by truncated edges 61, this edge being spaced from an adjacent shell wall. In its long dimension, the baffle divider 58 slightly exceeds the distance between inner faces of the header plates 33 and 34. Projection 62 at one end of the divider member is inserted in and accommodated in slot 46 in header plate 34. Bending of the tabs 64 and 65 relatively to projection 62 is accommodated by the cuts 63. In relation to the position of baffle divider member 58, it will be seen that Lube In fitting 14 communicates with the core unit below the baffle divider member while Lube Out fitting 15 communicates with the core unit above the baffle divider member.

In the use of the heat exchanger, the Fuel In fitting 22 and the Fuel Out fitting 23 are connected in a system supplying fuel under pressure to an engine. Lube In fitting 14 and Lube Out fitting 15 are connected in a system circulating a lubricating oil which is heated in use and which it is desired to cool by flowing it in heat transfer relation to the flowing fuel. The fuel entering the heat exchanger at inlet fitting 22 enters manifold chamber 24 where it has access to all of the tubes 47 communicating with manifold 24. Flowing through these tubes, the fuel reaches a turn-around chamber 66 as defined by dome member 21 where it has access to the remaining group of tubes 47. Using this remaining group of tubes as a flow path, the fuel returns toward manifold housing 18 and enters chamber 25, discharging from the heat exchanger by way of outlet fitting 23. In the oil circuit, oil which has been heated in use reaches the heat exchanger by way of inlet fitting 14. At the inlet fitting 14, the oil enters the shell by way of opening 12 therein and is admitted through registering opening 51 in the seal by-pass member to the core unit. The in-coming oil encounters the assembly of tubes 47 at a location below baffle divider 58 and distributes itself between baffle 54 and header plate 34 for motion transversely of the tube assembly substantially in the manner indicated by flow arrows in FIG. 5. As the flowing oil approaches a diametrically opposite shell portion it reaches truncated edge 56 of the baffle 54 and is allowed to flow over this edge and in a sense lengthwise of the tubes 47 to the other side of baffle 54. There, the oil distributes itself between the baffle 54 and header plate 33 and moves again transversely but in a reverse sense, still being confined by baffle divider 58 to a lower part of the heat exchanger core unit. In the course of this motion, the flowing oil encounters the truncated edge 61 of the baffle divider and is allowed to flow over this edge into an upper part of the core unit above the baffle divider. Here the flow is in a path which is the reverse of that just described, the oil flowing transversely across an upper portion of the tubes, around truncated edge 56 of baffle 54 and then back again on the other side of baffle 54 toward the seal by-pass member opening 52, registering shell opening 13 and communicating Lube Out fitting 15. The flowing oil accordingly is in an essentially cross flow relation to the tube assembly and effects such flow in multiple sinuous passes. The flowing oil is in contact with the tubes 47, and, through the tube walls, is in heat transfer relation to the relatively cool fuel flowing through the tubes. The oil accordingly rejects a substantial amount of its contained heat to the flowing fuel and exits the Lube Out fitting 15 in a cooled, conditioned form ready for reuse. In connection with flow of the oil, it will be observed that since annular surrounding space 48 is occupied by the seal by-pass member 49 no opportunity is afforded for the oil to by-pass the tube assembly. It is instead constrained to flow over and across the tubes for maximum realization of heat transfer capabilities. It may also be noted in connection with the seal by-pass member and with the baffle divider 58, that these members are positioned with respect to the core unit to exert, in conjunction with O-ring seals on the header plates 33 and 34, a cushioning effect upon the core unit. It may also be noted in connection with baffle divider member 58 that the tabs 64 and 65 thereof are bent downward or in a direction opposed to pressure exerted by oil entering the core by way of Lube In fitting 14. The pressure of the oil itself accordingly may be utilized in conjunction with the elastic memory of the material of the baffle divider to insure that tabs 64 and 65 are in an outspread sealing position inhibiting a by-pass of flow around side edges of the baffle divider. In the illustrated instance, opposite ends of the seal by-pass member are in an approximately touching relation so that both tabs 64 and 65 of the baffle divider member engage the shell 11 through the seal by-pass member. It is, of course, possible that these seal by-pass ends would be separated, in which case tab 65 would bear against the shell directly.

The manner of assembly of the heat exchanger will be largely self-evident from the drawings and description given. In general, however, baffle 54 and baffle divider member 58 are placed in an interfitting relation, with truncated edge 56 of the baffle member inserted in slot 59 of the baffle divider member. These parts are then positioned between header plates 33 and 34, with the projection 62 at one end of the baffle divider member being inserted in slot 46 in header plate 34. Tubes 47 are then installed, their ends being secured as before mentioned within through apertures 38 and 40 in the header plates. O-rings 36–37 and 41–42 are mounted in appropriate grooves in the header plates and the tube assembly between the header plates is wrapped by the seal by-pass member 49. In the wrapping process, slot 53 is made to coincide with the edge of baffle 54 and fitted thereover. The seal by-pass member is as a consequence keyed to and becomes a part of the core unit, relatively rotary and longitudinal movements thereof being positively prevented.

The assembled and wrapped core unit then is inserted in the shell 11 which in previous operations has had the dome member 21 welded to one end thereof and has had Lube In and Lube Out fittings 14 and 15 installed thereon. The spacing between apertures 51 and 52 in the seal by-pass member 49 is such as to agree with the angular spacing of openings 12 and 13 in the shell. The retainer ring 44 is installed in the groove 43 on header plate 34 and an introducing motion of the core unit into the shell is continued until retainer ring 44 abuts flange 16. This has the effect of properly positioning the core unit within the shell in a longitudinal sense and locates the apertures 51 and 52 properly longitudinally of the Lube In and Lube Out fittings. The manifold housing 18 now is brought into position to be mounted to the heat exchanger and the core unit is adjusted in a rotary sense as required so that slot 45 in the outer face of header plate 34 will receive reduced edge 27 of the partitioning member 26. Application of the manifold housing to the flange 16 is completed and bolts 19 are installed to complete the assembly. In applying manifold housing 18 to the flange 16 it will be seen that a projecting end of header plate 34 is received in bearing surface 29 of the manifold housing. On both sides of the line of separation between the flanges 16 and 17, therefore, there is provided an O-ring seal. A leakage or by-pass of either fuel or oil around the header plate 34 accordingly is prevented. The O-ring seals 36 and 37 accomplish a similar function at the opposite end of the heat exchanger core unit. A disassembly of the heat exchanger, for access to the core unit, involves merely a removal of bolts 19 and a lifting off of the manifold housing 18 to expose the core unit which can then be withdrawn from the shell.

The invention has been disclosed with respect to a particular embodiment. Structural modifications have been discussed and these and others obvious to a person skilled in the art to which this invention relates are considered to be within the intent and scope of the invention.

What is claimed is:

1. A brazeless heat exchanger of the tube and shell type, including a. a tubular shell, b. spaced apart apertured headers in said shell, c. resilient O-ring means in peripherally encircling relation to said headers and in a sealing contacting relation to an inner wall of said shell, d. heat exchange tubes positioning longitudinally in said shell and having their ends received in apertures in said headers, e. said tubes forming a tube assembly peripherally spaced from the said inner wall of said shell to be substantially unsupported thereby and said tube assembly and said headers forming a core unit, f. a seal by-pass member in an encircling relation to said tube assembly and occupying the space between said tube assembly and the said inner wall of said shell in substantially mutually contacting relation to said inner wall and to at least some of the peripherally positioning tubes of the tube assembly, g. said seal by-pass member being made of a flexible yielding material cooperating with said O-ring means in a cushioning of the core unit, inlet and outlet ports in said shell for a first fluid and positioning between said headers whereby said first fluid entering said shell by way of said inlet port may flow over and around said tubes and exit by way of said outlet port, said O-ring means inhibiting the escape of said first fluid over the periphery of said headers and said seal by-pass member inhibiting by-passing flow of said first fluid around said tube assembly, j. and baffle means installed in said core unit anchoring said seal bypass member to said core unit and guiding said first fluid in its flow between said inlet and said outlet for advantageous use of available heat transfer surface in said tube assembly, k. another fluid flowing through said tubes and being in heat transfer relation through the tube walls with said first fluid.

2. A brazeless heat exchanger according to claim 1, wherein, a. said seal by-pass member has a sheet-like form of a thickness substantially to fill the space between the tube assembly and the said inner wall of said shell and has dimensions to be substantially coextensive of said tube assembly between said spaced apart headers, b. said member wrapping around the tube assembly with opposite ends in an approaching relation to respective headers and opposite side edges in an approaching relation to one another, c. said member having openings aligning with respective shell inlet and outlet ports and allowing said first fluid to enter and to depart from said core unit.

3. A brazeless heat exchanger according to claim 2, wherein a. said seal by-pass member is made of a tetrafluoroethlene material.

4. A brazeless heat exchanger according to claim 3, wherein said installed baffle means includes a. a baffle divider positioning in said core unit longitudinally of said tubes to enforce a circuitous path of flow for said first fluid between said inlet and said outlet, b. said baffle divider being made of a material like said seal by-pass member and having side edges projected as tabs in a sense laterally of the tube assembly and bent to utilize a principle of elastic memory to bear against wall surfaces surrounding said core unit.

5. A brazeless heat exchanger according to claim 4, wherein a. the projected side tabs of said baffle divider are bent over towards said inlet.

6. A brazeless heat exchanger according to claim 1, wherein said installed baffle means includes a. a baffle positioning in said core unit transversely of said tubes and apertured for passage of said tubes therethrough, and a baffle divider positioning in said core unit longitudinally of said tubes, said baffle and said baffle divider enforcing a circuitous path of flow for said first fluid between said inlet and said outlet, edges of said baffle and said baffle divider being adapted to interfit.

7. A brazeless heat exchanger according to claim 6, a. said baffle having a truncated disc-like form, a cutoff portion of the baffle facing in a direction away from said inlet.

8. A brazeless heat exchanger according to claim 7, a. said baffle being surrounded by said seal by-pass member, b. said seal by-pass member being slotted to accommodate a peripheral edge of said baffle in an interlocking relation of the parts.

9. A brazeless heat exchanger according to claim 4, a. at least one of said headers having a transverse slot in a face thereof, b. an end of said baffle divider being received in said slot.

10. A brazeless heat exchanger according to claim 1, including a. dome means secured to one end of said shell beyond a first header and constituting a turnaround chamber for said other fluid, b. and a manifold housing secured to the opposite end of said shell providing an inlet and an outlet for said other fluid and providing means cooperative with a second header to define inlet and outlet manifold chambers guiding flow of said other fluid from said inlet therefor through a portion of said tube assembly to said dome means and back through another portion of said tube assembly to said outlet for said other fluid.

11. A brazeless heat exchanger according to claim 10, wherein a. said means cooperating with said second header includes a partitioning member, b. said second header having a slot to receive said partitioning member, c. and the cooperation between said partitioning member and said slot serving to define said manifold chambers and to position said core unit in a rotary sense.

12. A brazeless heat exchanger of the tube and shell type, including a. a tubular shell, b. spaced apart apertured headers in said shell, c. heat exchange tubes positioning longitudinally in said shell and having their end received in apertures in said headers, d. said tubes forming a tube assembly peripherally spaced from the said inner wall of said shell to be substantially unsupported thereby and said tube assembly and said headers forming a core unit, e. a seal by-pass member in an encircling relation to said tube assembly and occupying the space between said tube assembly and the said inner wall and of said shell in substantially mutually contacting relation to said inner wall and to at least some of the peripherally positioning tubes of the tube assembly, f. said seal by-pass member being made of a flexible yielding material, g. inlet and outlet ports in said shell for a first fluid and positioning between said headers whereby said first fluid entering said shell by way of said inlet port may flow over and around said tubes and exit by way of said outlet port, h. means inhibiting the escape of said first fluid over the periphery of said headers and said seal by-pass member inhibiting by-passing flow of said first fluid around said tube assembly, i. and baffle means installed in said core unit anchoring said seal bypass member to said core unit and guiding said first fluid in its flow between said inlet and said outlet for advantageous use of available heat transfer surface in said tube assembly, j. another fluid flowing through said tubes and being in heat transfer relation through the tube walls with said first fluid.

* * * * *

UNITED STATES PATENT OFFICE

CERTIFICATE OF CORRECTION

PATENT NO. : 4,029,145

DATED : June 14, 1977

INVENTOR(S) : Robert R. Pfouts, Thomas E. Earl, Charles B. Mort

It is certified that error appears in the above-identified patent and that said Letters Patent are hereby corrected as shown below:

Column 7, line 56, sub-heading -- h. -- should be inserted before "inlet";

Column 7, line 61, sub-heading -- i. -- should be inserted before "said O-ring";

Column 9, line 30, -- ends -- should be substituted for "end";

Column 10, line 25 -- port -- should be inserted after "inlet"; and

Column 10, line 26 -- port -- should be inserted after "outlet".

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*